US006164450A

United States Patent [19]

Benedetti

[11] Patent Number: 6,164,450

[45] Date of Patent: Dec. 26, 2000

[54] NON-RESEALABLE BOTTLE AND CONTAINER THEREFOR

[76] Inventor: Giovanni Benedetti, 21 Overton Drive, West Kilbride, Ayrshire KA23 9LQ, United Kingdom

[21] Appl. No.: 09/355,473

[22] PCT Filed: Feb. 2, 1998

[86] PCT No.: PCT/GB98/00202

§ 371 Date: Oct. 1, 1999

§ 102(e) Date: Oct. 1, 1999

[87] PCT Pub. No.: WO98/33468

PCT Pub. Date: Aug. 6, 1998

[30] Foreign Application Priority Data

Jan. 31, 1997 [GB] United Kingdom ..... 9702056

[51] Int. Cl.[7] ..... B65D 69/00

[52] U.S. Cl. ..... 206/570; 215/48; 215/49; 215/399

[58] Field of Search ..... 215/48, 49, 251, 215/390, 399; 206/570, 803; 220/23.4, 23.83, 751

[56] References Cited

U.S. PATENT DOCUMENTS

| | | | |
|---|---|---|---|
| 363,690 | 5/1887 | Sleeper | 206/803 |
| 512,101 | 1/1894 | Eastes | 206/803 |
| 1,512,981 | 10/1924 | Gordon | 206/570 |
| 4,509,639 | 4/1985 | Thompson | 206/159 |
| 4,620,638 | 11/1986 | Schmidt | 215/49 |
| 4,740,206 | 4/1988 | Allander | 604/294 |
| 4,881,283 | 11/1989 | Liautaud | 4/620 |
| 4,928,830 | 5/1990 | Brewer | 206/570 |
| 5,158,213 | 10/1992 | Latraix | 215/49 |
| 5,203,838 | 4/1993 | Schneider | 215/48 |
| 5,228,593 | 7/1993 | O'Meara | 215/48 |
| 5,878,900 | 3/1999 | Hansen | 215/251 |

FOREIGN PATENT DOCUMENTS

| | | |
|---|---|---|
| 94 101 | 11/1983 | European Pat. Off. . |
| 160 414 | 11/1985 | European Pat. Off. . |
| 86/05682 | 10/1986 | WIPO . |
| 87/02237 | 4/1987 | WIPO . |

*Primary Examiner*—David T. Fidei
*Attorney, Agent, or Firm*—Ratner & Prestia

[57] ABSTRACT

There is described a bottle which once opened, cannot be resealed. The bottle is particularly suitable for medical applications, especially for holding eye wash solutions for emergency use. The bottle operates by having a head portion located within the cap, so that when the cap is twisted the head portion is at least partially removed from the remainder of the bottle. The head portion cannot then be reattached to the remainder of the bottle. Also described is a container for holding a non-resealable bottle, the container having a ledge, which co-operates with a part of the bottle which is only present in the unopened form. For example the cap or head portion of the bottle may comprise a lip or projection. The container plus at least one unopened bottle of the invention is useful as an emergency eye wash station.

11 Claims, 13 Drawing Sheets

NON-RESEALABLE BOTTLE AND CONTAINER THEREFOR

BACKGROUND OF THE INVENTION

1. Field of the Invention

This invention relates to a bottle, particularly to a bottle useful for medical appliances such as eyewash bottles, and to a container adapted to hold such bottles.

2. Prior Art

Previous designs of eyewash dispensers for emergency or first aid use generally comprise squeezable wash bottles which are located in an easily-accessible container or eyewash station. The eyewash bottles are filled with sterile saline or other sterile liquid suitable for irrigating the eye(s) of a patient during treatment. The eyewash bottle is designed for single use only and generally bears instructions to discard any used or opened bottles, including any excess liquid contained therein. However, despite such warnings, it is frequent practice for open and partially used eyewash bottles to be replaced in the container. The remaining contents of an opened eyewash bottle are of course no longer sterile and can become infected, thereby constituting a medical hazard for subsequent users.

BRIEF SUMMARY OF THE INVENTION

According to the present invention there is provided a non-resealable bottle wherein said bottle has a head portion which is located within a cap, and whereby twisting of said cap relative to said bottle causes twisting and at least partial removal of said head portion thereby opening said bottle.

An important preferred feature of the bottle is that once the cap has been twisted to move the head portion and open the bottle, the head portion and the cap cannot be re-applied to the bottle. Preferably, in this regard, the cap has a slot or channel into which the head portion fits. Optionally the head portion fits tightly into the slot or channel and is retained therein by friction thereby holding the cap onto the bottle.

Alternatively, the cap may be designed to snap onto the bottle; the inner surface of the cap and outer surface of the neck of the bottle having suitable co-operating ridges and/or indentations to produce a snap fit. Thus, twisting the cap relative to the bottle also twists the head portion of the bottle, preferably removing it entirely from the bottle, and preventing reattachment of the cap to the bottle since there is no means of reattaching the head portion to the remainder of the bottle.

The cap is not generally responsible for sealing the bottle as usually the bottle is sealed by the head portion and is opened once the head portion is removed from the bottle.

The present invention also provides a container for a non-resealable bottle, the container having means to support the bottle by a portion which is attached to the unopened bottle but is removed therefrom when the bottle is opened.

The bottle may be described as above. Conveniently, the portion Consists of a projection or lip on the cap of the unopened bottle which engages a support means on the container. Thus, since twisting the cap to open the bottle prevents the cap being reapplied to the bottle, once the bottle is opened it cannot be properly re-located in the container.

Alternatively, the head of the bottle may be moulded to include the projection or lip; the bottle being opened by simply snapping the head off from the bottle.

Alternatively, the container may comprise a cap-like portion able to engage with the head of the bottle as previously described. In this embodiment the cap-like portion forms an integral part of the container but may be rotatable and/or detachable to facilitate easy removal of a detached head portion of an opened bottle. In this embodiment the cap-like portion of the container can be considered to be the "support means" referred to above.

Without the co-operation of the bottle portion and the support means of the container, the bottle cannot be held correctly in the container. Generally therefore the container and/or the bottle are shaped so that the bottle cannot be simply stood up on the lower surface of the container. Thus, for example, the non-capped end of the bottle may be rounded and/or the lower surface of the container may be rounded (i.e scoop shaped) or sloping.

The bottles according to the present invention may contain any fluid intended for single use applications. Examples include physiological or medical fluids (eg saline, plasma, blood, solutions of antibiotics or other medical agents) and laboratory reagents (eg cell culture media and the like). The bottles of the present invention are especially suitable for containing eyewash fluids for first aid use.

The present invention also provides an eyewash dispenser system comprising a container as defined above and at least one bottle as defined above.

The container according to the present invention can be formed from one or a combination of different materials. Suitable materials are plastics or metals, or any similarly robust material.

Suitable plastics materials include polyvinyl chloride, polymethylmethacrylate, polymethacrylate, polyacrylonitrile, polyamides, polybutadiene, polychloroprene, polyester, polyethylene, polyphenylene oxide, polypropylene, poly(vinyl acetate), poly(vinylidene) chloride, Kevlar®, or copolymers or derivatives of any of these.

Suitable metals include aluminium, steel or stainless steel.

BRIEF DESCRIPTION OF THE DRAWINGS

The invention will now be described by way of example, and with reference to the accompanying drawings, in which.

DETAILED DESCRIPTION OF THE INVENITON

Figure 1:
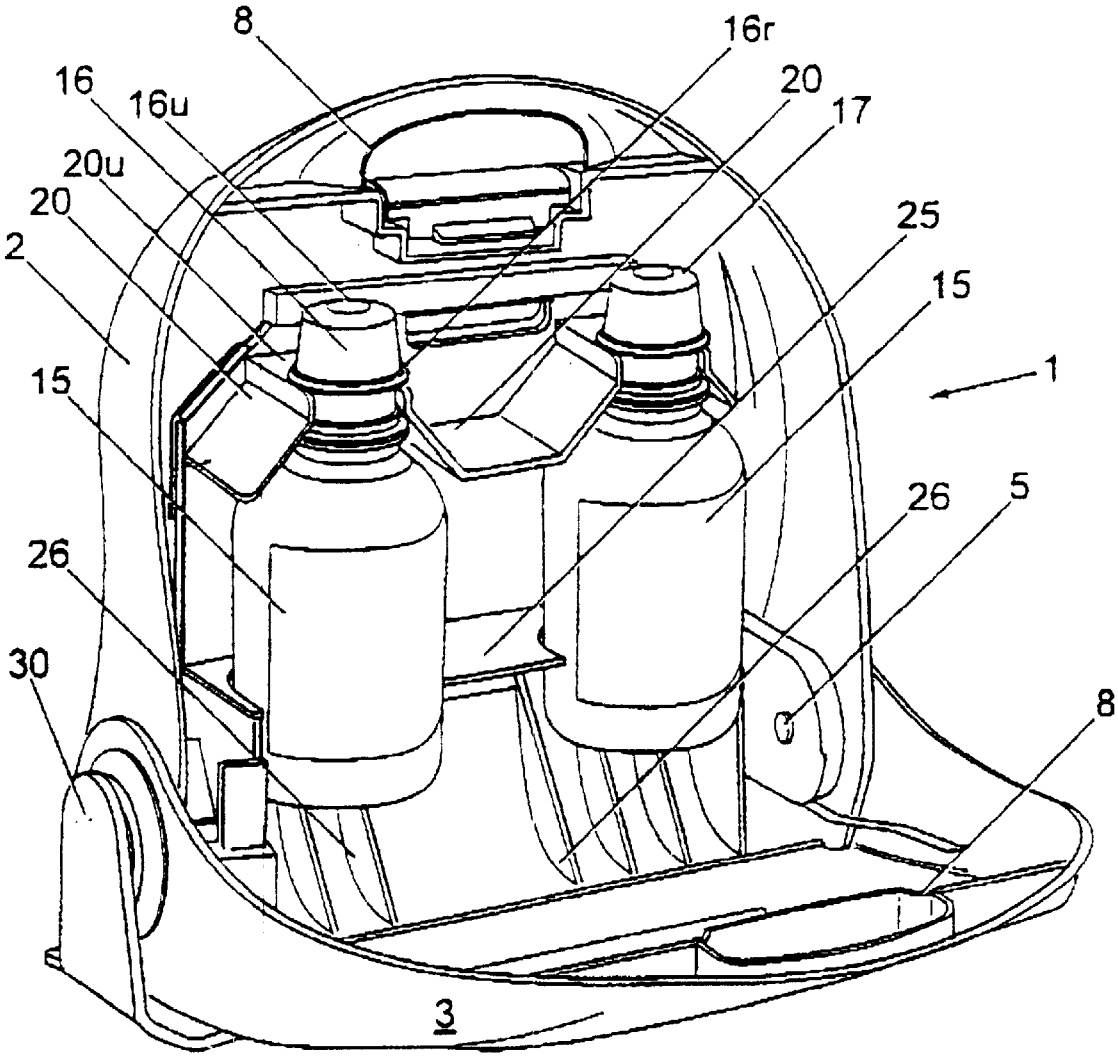
FIG. 1 is a perspective view of an opened container according to one embodiment of the invention and two unopened bottles of the invention.

Referring now to the drawings, a container 1 has a base 2 and a lid 3. The base 2 and lid 3 are pivotally joined at 5 by Screws or other such fixings such that the lid 3 can move pivotally to cover the base 2.

Figure 2:
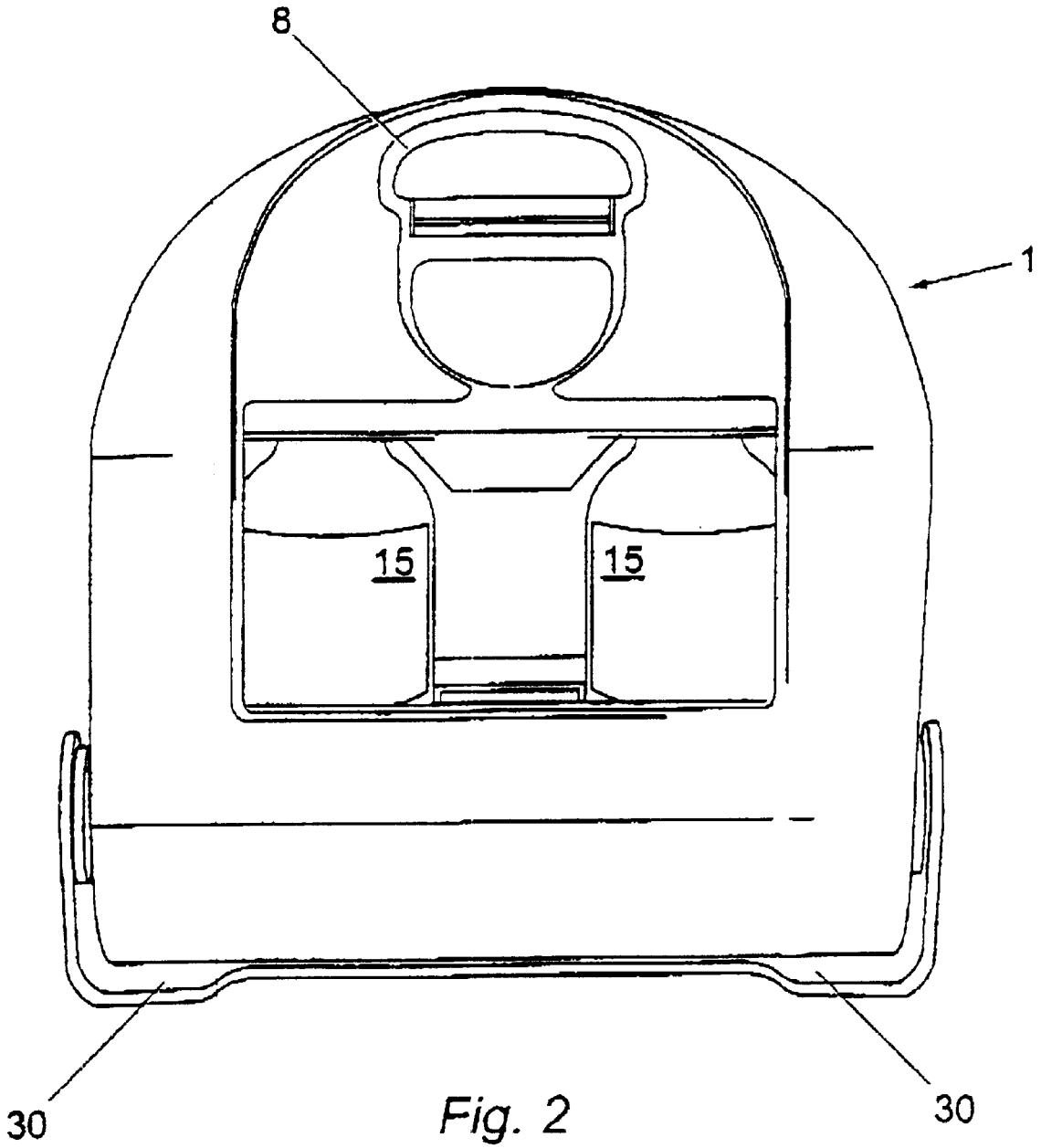
FIG. 2 shows a front view of the closed container of FIG. 1.
Figure 3:
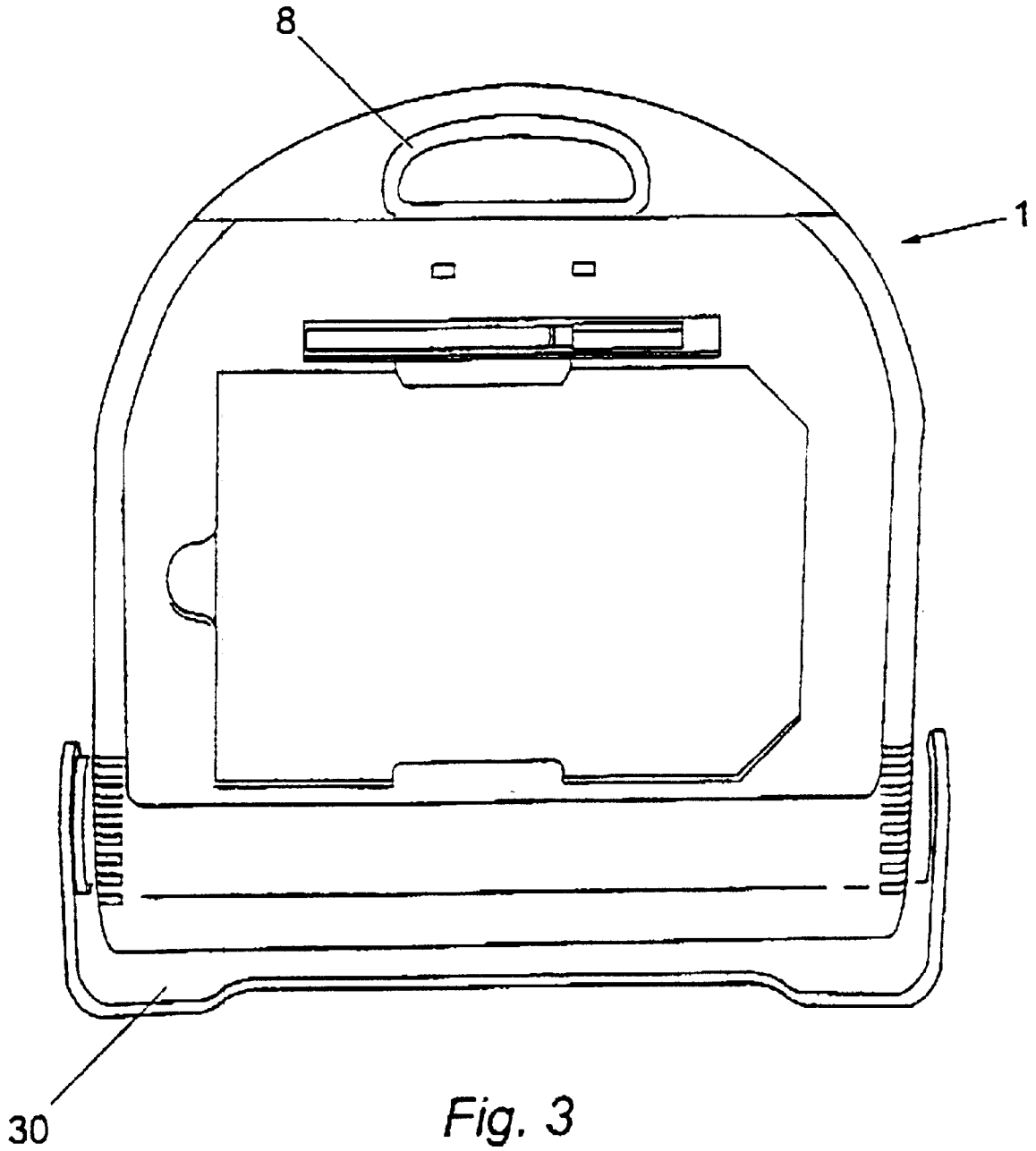
FIG. 3 shows a back view of the container of FIG. 1.
Figure 4:
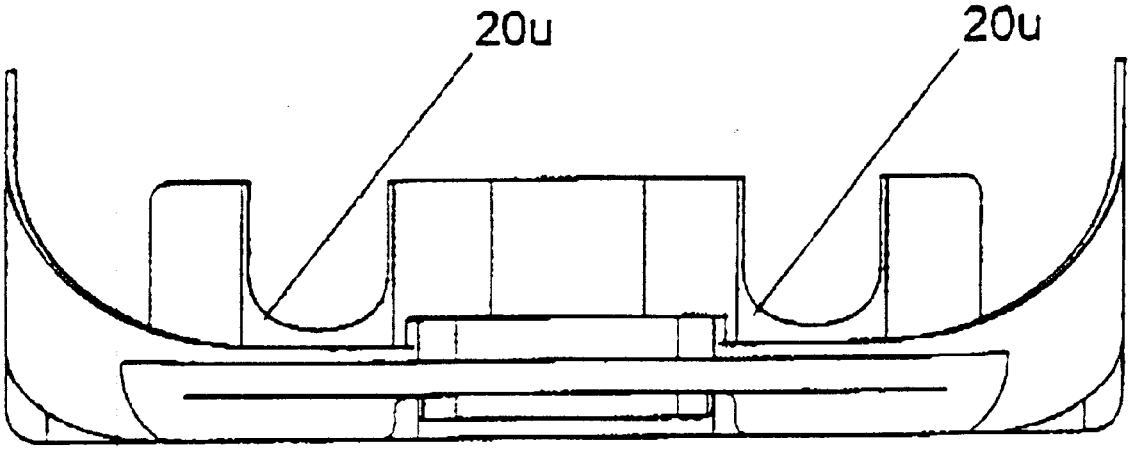
FIG. 4 is a view from above of the FIG. 1 container base.
Figure 5B:
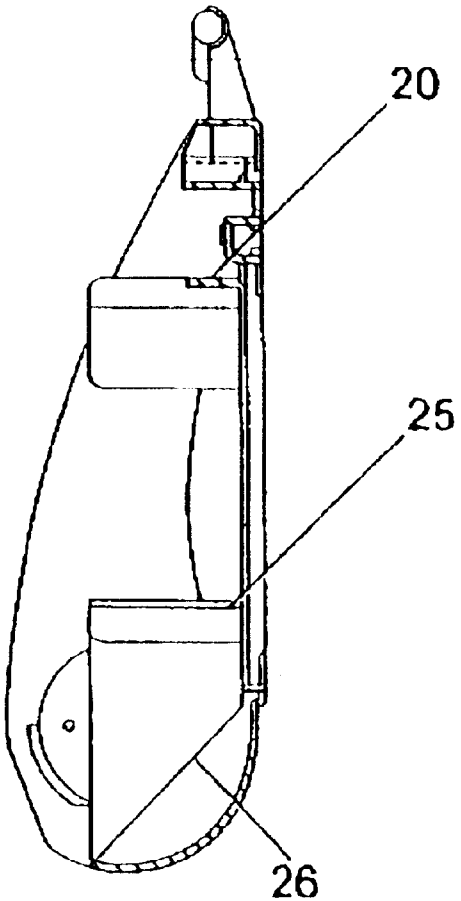
FIG. 5*a* shows a front and side view 5*b* of the FIG. 1 base.
Figure 5A:
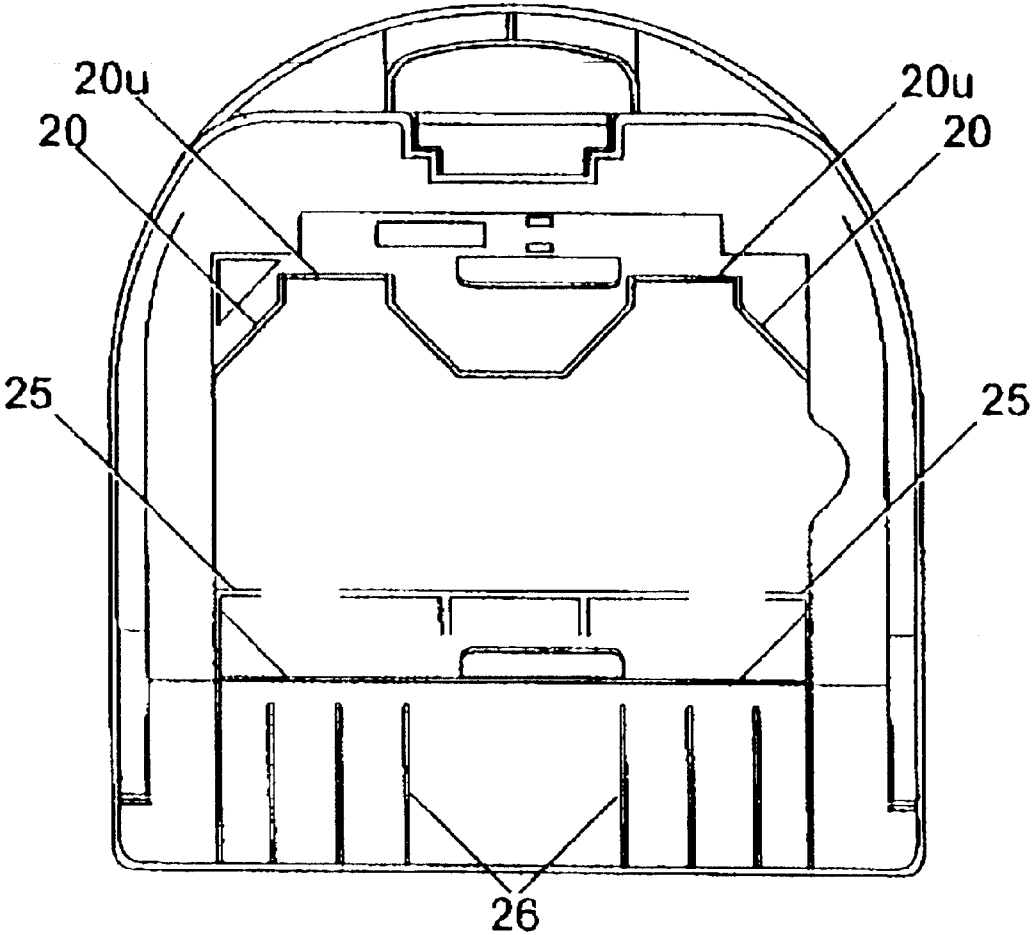

The lid 3 and base 2 each have a cut-away portion to provide a handle 8, and the lid 3 has a further cutaway portion for receiving a visor 10 (FIG. 2).

Bottles 15, which preferably contain eye wash fluid, are stored in the container and are held in place by hangers 20 and scalloped inner walls 25 located on the base 2. The inner walls 25 have scallops which fit part of the way around the circumference of the bottle 15 to prevent sideways movement of the bottle 15, but give no support to the bottle's weight when the bottle 15 is upright. The hanger 20 has a scallop 20*s* for receiving a cap 16 of the bottle 15, and has upper surfaces 20*u* which, in use of the container 1, can support the cap 16 and hence the bottle 15, when the cap 16 and bottle 15 are connected and are upright in the container 1.

Figure 8:
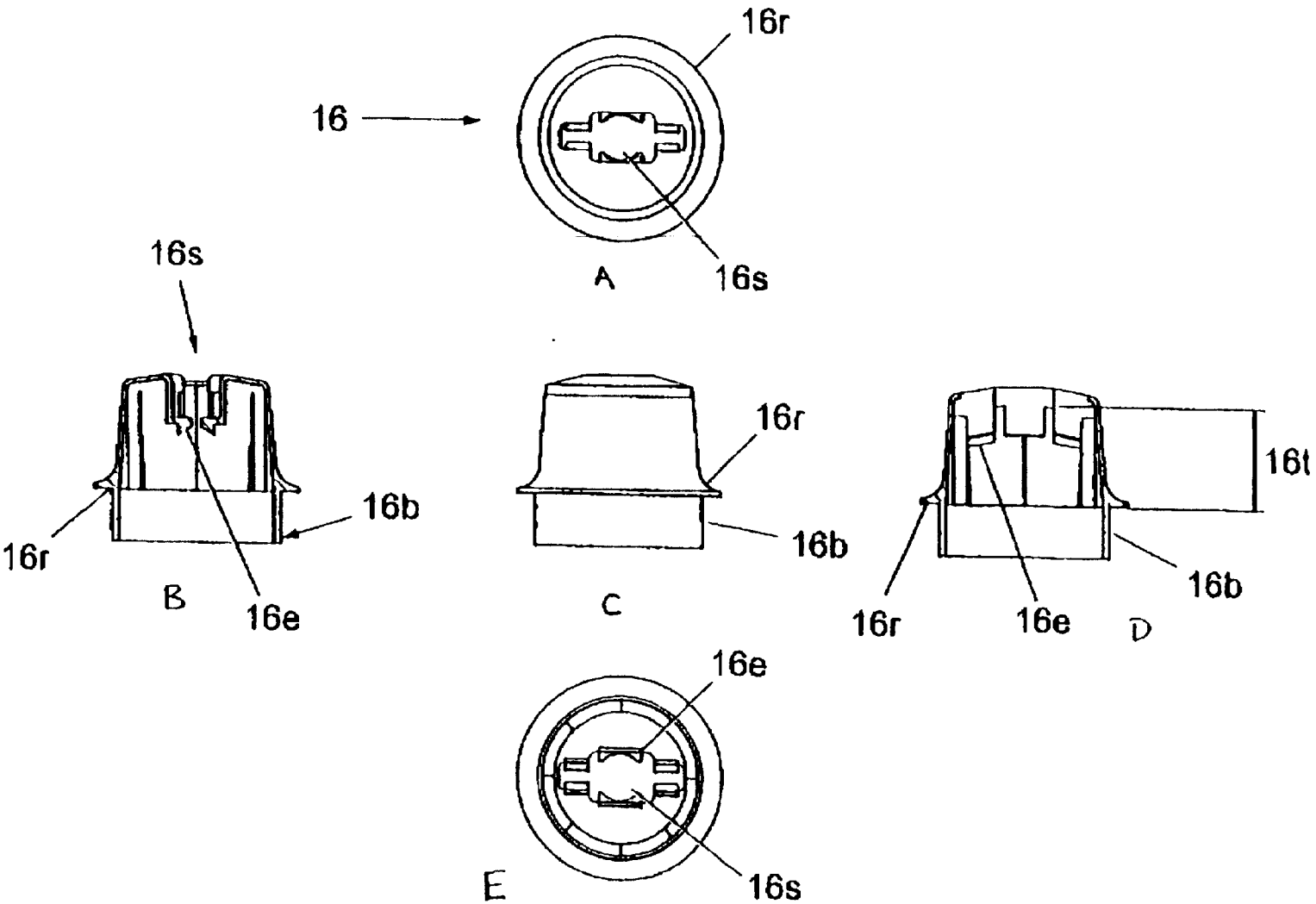
FIG. 8 shows five views of a bottle cap for the FIG. 1 bottle. A is the view from above; B is the transverse cross section; C is the side view; D is the lateral cross section; and E is the view from below.

The cap 16 is shown in detail in FIGS. 8A to 8E. As illustrated cap 16 has a base 16*b* and an annular ring 16*r* which separates the base 16*b* from a top portion 16*t* (see FIG. 8D). The ring 16*r* has a flat lower surface adjacent the base 16*b*, which surface abuts against the hanger 20 in use. The top portion 16*t* incorporates a rectangular slot 16*s* having inturned lower edges 16*e*. As shown in FIG. 8E it is possible to include a clip or snap-fit arrangement to hold the head of the bottle into place.

The cap 16 is dimensioned to be a tight fit with the head 17 of the bottle 15 so that the head 17 of the bottle 15 fits within the slot 16*s* of the cap 15. The frictional coupling between the cap 16 and the bottle 15 is such that the bottle 15 and cap 16 can be supported together by the upper surface 20*u* of the hanger 20. Alternatively the cap 16 may be a snap fit with the head 17 of the bottle 15.

Twisting of the cap 16 relative to the bottle 15 turns the head 17 of the bottle 15 in the slot 16*s,* eventually causing the head 17 to be twisted away from the bottle 15 and allowing immediate use of the bottle 15 for emergency use, e.g eye wash procedures. The bottle head 17 cannot be reattached to the bottle 15 and the cap 16 cannot fit onto the neck of the bottle 15. Therefore an opened bottle 15 cannot be supported in the container 1.

Figure 9A:
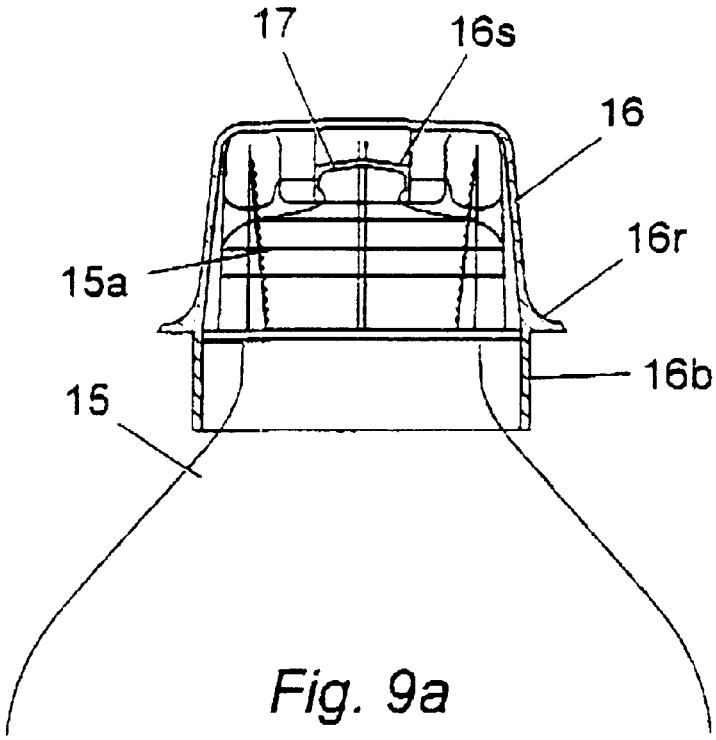
FIG. 9*a* shows a front elevation of a sealed bottle with the head fitted within the cap.
Figure 9B:
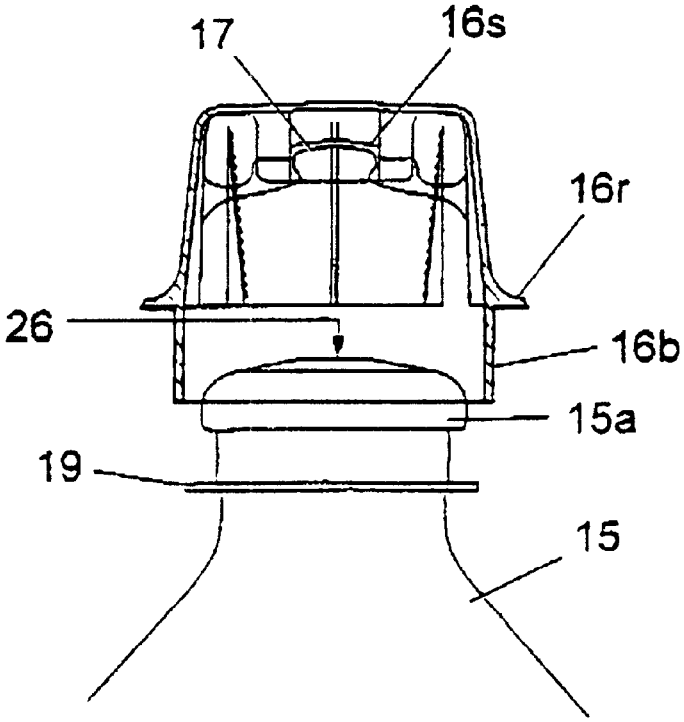
FIG. 9*b* shows a front elevation of an open bottle with the head retained within the cap which is partially removed from the bottle.
Figure 10A:
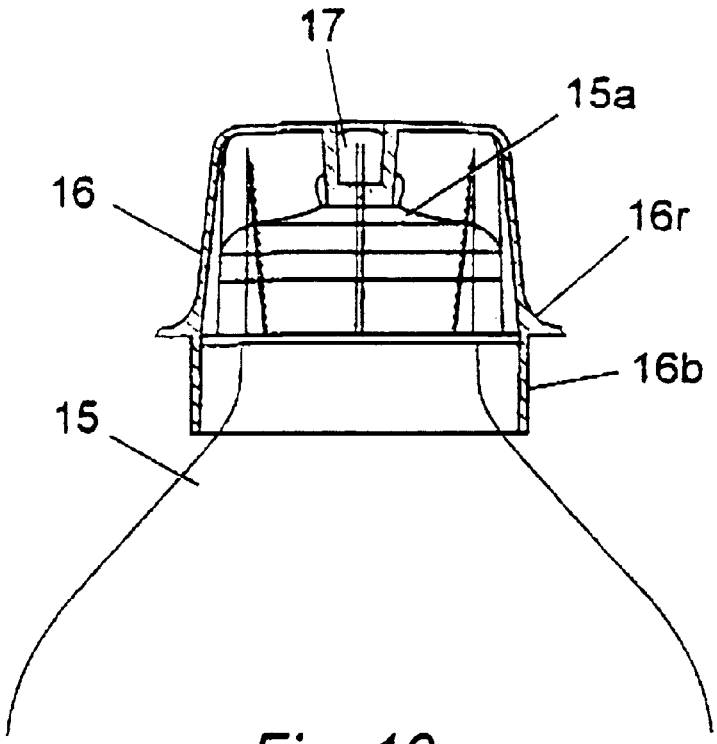
Fig 10*a* shows a side elevation of the sealed bottle of FIG. 9*a;*
Figure 10B:
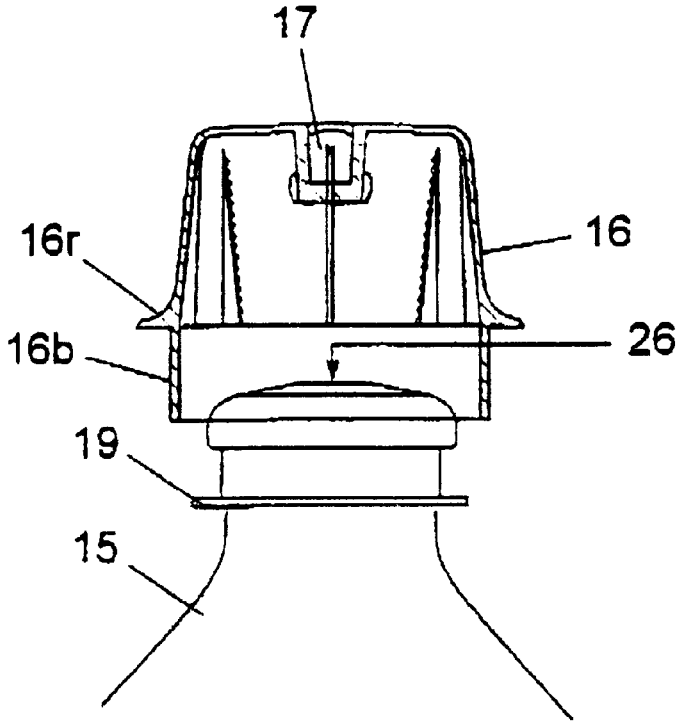
FIG. 10*b* shows a side elevation of the open bottle of FIG. 9*b;*

FIGS. 9*a* and 10*a* show the head 17 of the bottle 15 engaged within the cap 16. In this embodiment the top of the bottle 15 comprises a dome-shaped portion 15*a* which is sealed by a flange-shaped head 17. Head 17 is located within slot 16*s* of cap 16. Twisting of cap 16 relative to the flange-shaped bottle head 17 will cause the flange 17 to twist relative to the dome-shaped portion 15*a*. Ultimately flange 17 will be removed from the remainder of bottle 15 whereupon the dome-shaped portion 15*a* will terminate with opening 26 through which liquid can be poured. Head 17 is retained within the cap 16 (see FIGS. 9*b* and 10*b*) and cannot be reattached to the dome-shaped portion 17*a*. Thus, bottle 15, once opened, cannot be resealed.

Figure 11A:
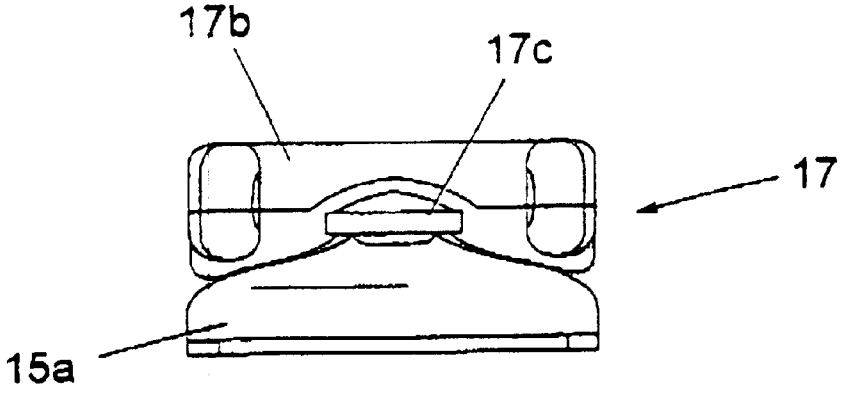
FIG. 11*a* shows a front elevation of the top of a bottle without a cap.
Figure 11B:
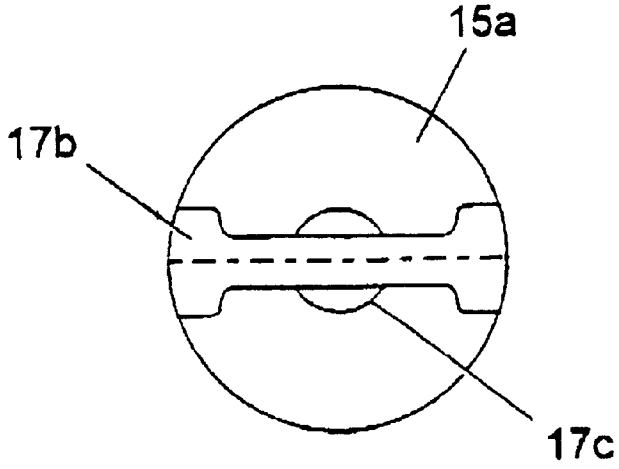
FIG. 11*b* shows a plan elevation of the top of a bottle of FIG. 11*a;*
Figure 11C:
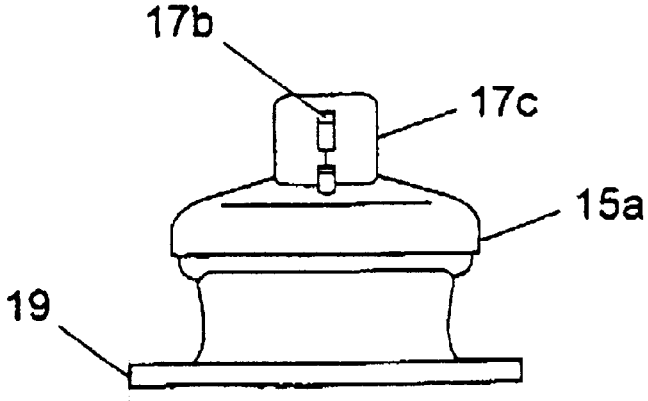
FIG. 11*c* shows a side elevation of the top of the bottle of, FIG. 11*a;*

The bottle 15 sealed by head 17 is shown in more detail and without a cap in FIGS. 11*a–c*. The head 17 when viewed from the front and the top (FIGS. 11*a* and *b*) is continuous with the dome-shaped portion 15*a*. Head 17 is shaped such that it will fit within slot 16*s*. Head 17 comprises a flange 17*b* and a bulbous middle portion or nipple 17*c* which communicates with the interior of the bottle. During opening of the bottle 15 by twisting head 17, the nipple 17*c* is sheared off, so producing opening 26. The top portion of the bottle 15 with the head 17 affixed thereto is shown in FIG. 11*c,* and also shown is the portion 19 of the bottle 15 to which the cap 15 can be attached, for example in a snap fit arrangement.

Figure 12A:
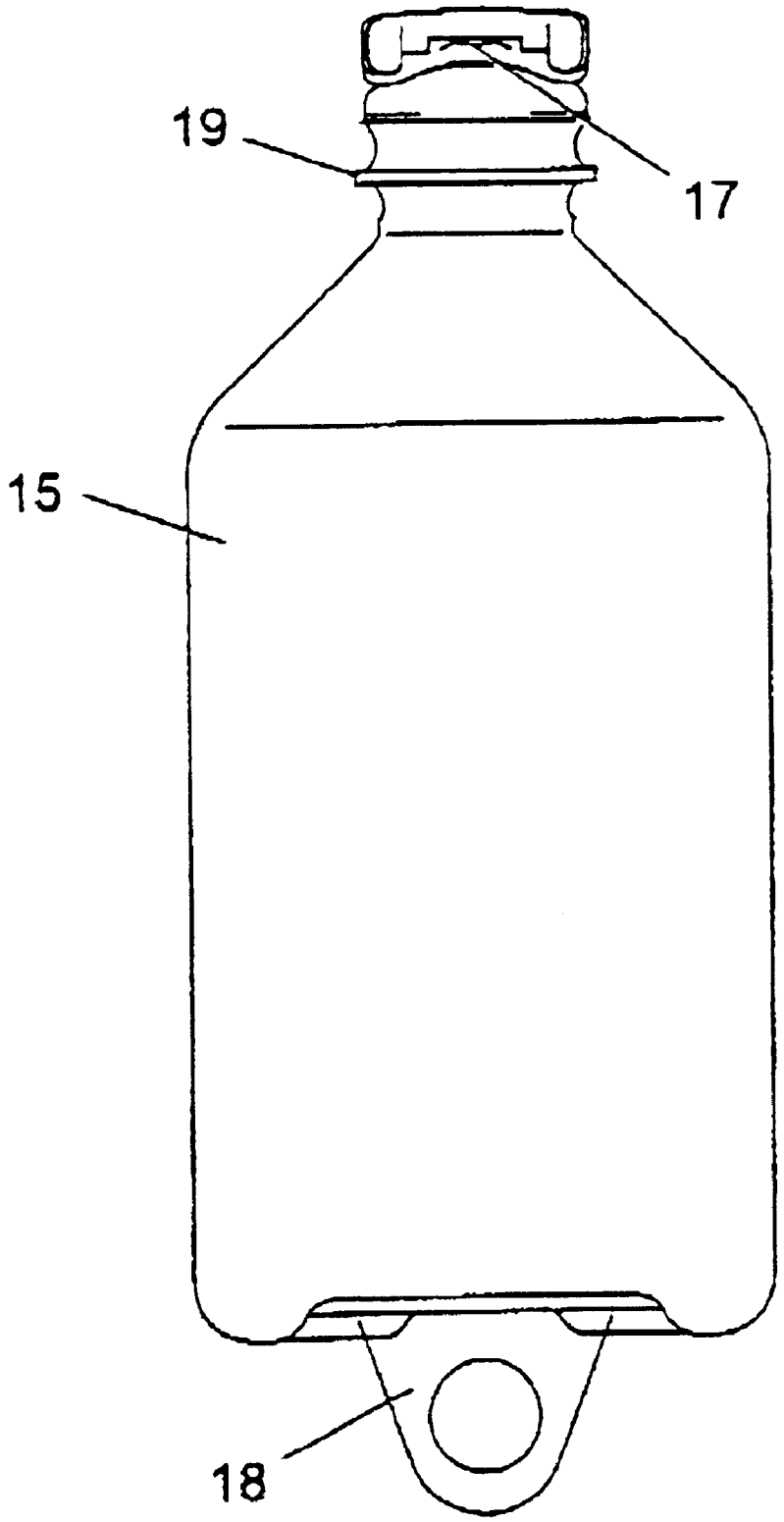
FIG. 12*a* shows a front elevation of a sealed bottle without a cap.
Figure 12B:
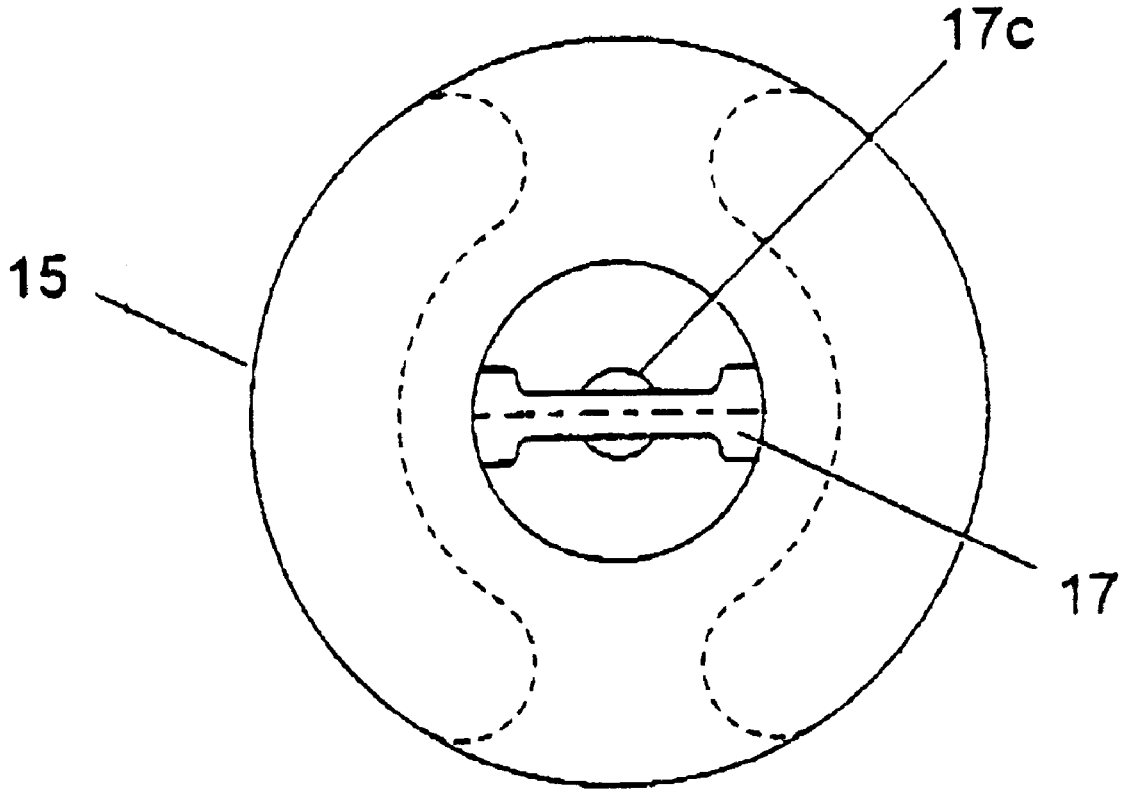
FIG. 12*b* shows a plan elevation of the bottle of FIG. 12*a*.

The bottle 15 shown in FIG. 12*a* has a hanger 18 which allows the bottle 15 to hung upside down on a stand (not shown) to allow the contents of the bottle 15 to be administered to the patient in the convention manner.

Alternatively, in a further embodiment of the present invention, the cap 16 and head 17 are permanently affixed to each other such that twisting of the cap 16 causes the head 17 and cap 16 to be removed from the bottle 15. The removed cap 16 and head 17 cannot then be re-connected to the neck of bottle 15 and, as described for the previous embodiments, the opened bottle 15 cannot be returned to the container 1.

Figure 6B:
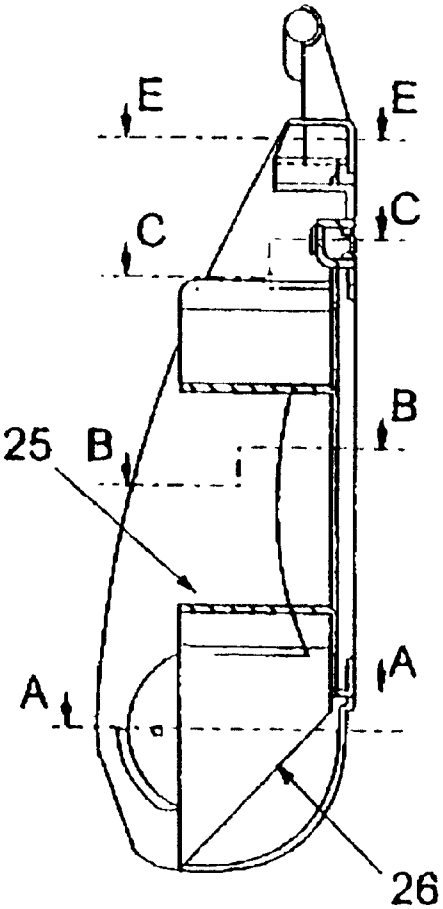
FIG. 6*a* shows side and section 6*b* views of the FIG. 1 base.
Figure 6A:
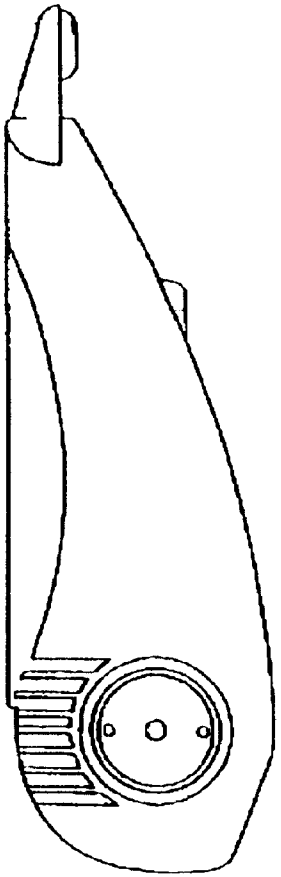
Figure 7A:
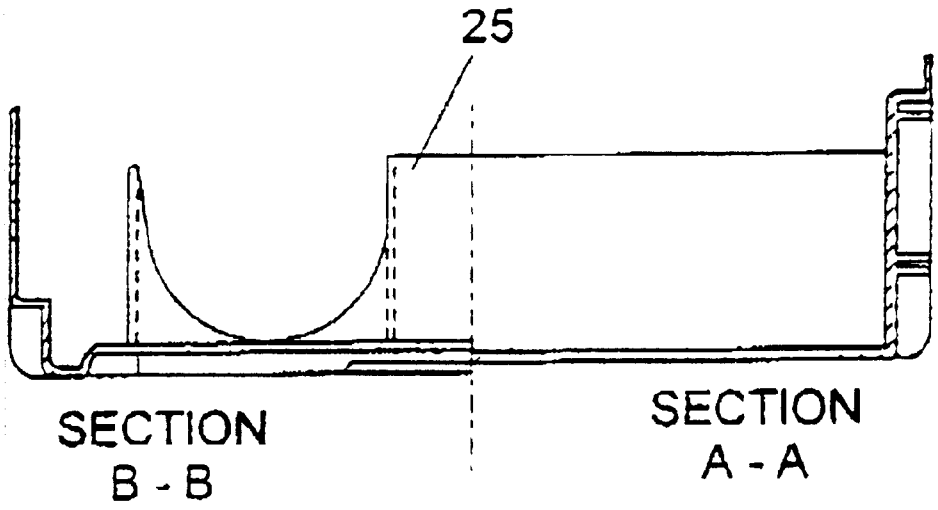
FIG. 7*a* shows a sectional view of the container, the left hand portion of the figure shows a view through line B—B of FIG. 6*b*; the right hand portion of the figure shows a view through line A—A of FIG. 6*b;*
Figure 7B:
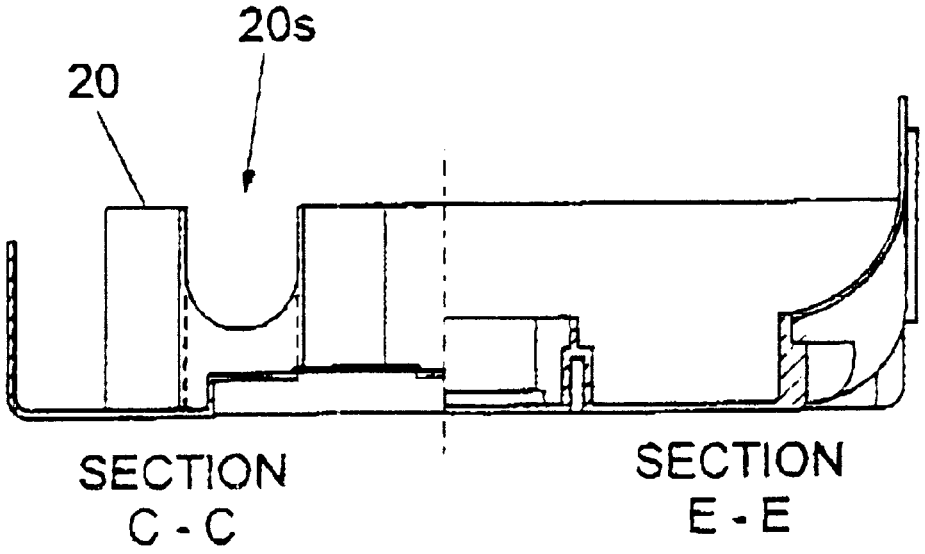
FIG. 7*b* shows a sectional view of the container, the left hand portion of the figure shows a view through line C—C of FIG. 6*b*; the right hand portion of the figure shows a view through line E—E of FIG. 6*b;*

The-container 1 has one or more sloped inner surfaces 26 below the base of the bottles 15 (FIG. 1). These sloped surfaces 26 may be in the form of plurality of vanes (as in FIG. 1) or one or more flat surfaces 26 as illustrated in FIG. 6*b*. The sloped surface 26 may alternatively present one or more curved surfaces which do not allow a bottle 15 (opened or unopened) to stand upright when the container 1 is in an upright position. Additionally, the sloped inner surfaces 26 prevent an opened bottle 15 from being properly placed in the container 17. An opened bottle 15 placed in the container 1 will not be able to be located on the hanger 20 and the bottle 15 will slip down the sloped inner surface 26 and prevent the container 1 from being closed or from remaining closed when the container 1 is placed in an upright position. As a result of the bottle 15 slipping down the sloped surface 26 the base of the bottle 15 pushes outwardly towards the lid 3 thus preventing the lid 3 from being closed or from remaining closed.

Thus, the present invention ensures that only unopened bottles 15 can be placed in the container 1.

A wall bracket 30 can be provided if desired to mount the container 1 on a wall or to allow the container 1 to be free standing on the surface. Optionally, the container 1 may be releasably detachable from the fixed wall brackets 30 and such an arrangement enables the container 1 to be quickly taken to a patient requiring first aid treatment.

Modifications and improvements can be incorporated without departing from the scope of the invention. For example, pens and accident report books or first aid advice can also be stored on the container 1.

What is claimed is:

1. A non-resealable bottle wherein said bottle has a head portion connected to a cap, and whereby twisting of said cap relative to said bottle causes twisting and at least partial removal of said head portion and cap from the bottle thereby opening said bottle, wherein said head portion and cap cannot be re-attached to the bottle once said bottle is opened, and wherein said cap has a portion which co-operates with supporting means provided on a container for holding said bottle.

2. A bottle as claimed in claim 1 wherein the cap has a slot or channel into which the head portion fits.

3. A bottle as claimed in either one of claims 1 or 2 wherein the head portion is held by friction onto the cap of the bottle.

4. A bottle as claimed in either one of claims 1 or 2 wherein the cap forms a snap fit with the head portion of the bottle.

5. A bottle (container) as claimed in any one of claims 1 or 2 containing eye was fluid.

6. A container for holding a non-resealable bottle, the container having supporting means to support said bottle, said bottle having a head portion connected to a cap, and whereby twisting of said cap relative to said bottle causes twisting and at least partial removal of said base portion and cap from the bottle thereby opening said bottle, wherein said head portion and cap cannot be re-attached to the bottle once said bottle is opened, and wherein said cap has a portion which co-operates with said supporting means provided on said container,.

7. A container as claimed in claim 6 wherein said portion is a projection or lip on said cap which engages a support means on the container.

8. The bottle as claimed in claim 1, wherein said portion is a projection or lip on said cap which engages said supporting means on the container.

9. The container as claimed in claim 6, wherein said supporting means is a hanging means.

10. An assembly comprising a non-sealable bottle and a container for holding said bottle, wherein:

said bottle has a head portion which is connected to a cap, and whereby twisting of said cap relative to said bottle causes twisting and at least partial removal of said head portion and cap from the bottle thereby opening said bottle, wherein said head portion and cap cannot be re-attached to the bottle once said bottle is opened and wherein said cap has a portion which co-operates with supporting means provided on a container for holding said bottle;

the container has supporting means to support the bottle by co-operating with said portion of said cap connected to the head portion of the unopened bottle, and wherein said supporting means cannot support an open capless bottle; and wherein said container is shaped to prevent the opened bottle being replaced in said container.

11. The assembly as claimed in claim 10, wherein said bottle contains eye wash fluid and wherein said assembly is an eyewash dispenser system.

* * * * *

UNITED STATES PATENT AND TRADEMARK OFFICE

CERTIFICATE OF CORRECTION

PATENT NO. : 6,164,450
DATED : December 26, 2000
INVENTOR(S) : Benedetti

It is certified that error appears in the above-identified patent and that said Letters Patent is hereby corrected as shown below:

Column 5,
Line 19, should read:
5. A bottle as claimed in any one of claims 1
Line 20, should read -- or 2 containing eye wash fluid. --

Column 6,
Line 30, should read -- said container.--.

Signed and Sealed this

Twelfth Day of February, 2002

*Attest:*

*Attesting Officer*

JAMES E. ROGAN
*Director of the United States Patent and Trademark Office*